US005525180A

United States Patent [19]

Paul, Jr. et al.

[11] Patent Number: 5,525,180

[45] Date of Patent: Jun. 11, 1996

[54] METHOD FOR PRODUCING CHOPPED FIBER STRANDS

[75] Inventors: James T. Paul, Jr.; Warren C. Schimpf, both of Wilmington, Del.

[73] Assignee: Hercules Incorporated, Wilmington, Del.

[21] Appl. No.: 263,494

[22] Filed: Jun. 20, 1994

Related U.S. Application Data

[63] Continuation of Ser. No. 14,020, Feb. 5, 1993, abandoned.

[51] Int. Cl.[6] ..... B26D 7/08; B02C 23/00

[52] U.S. Cl. ..... 156/250; 19/0.46; 19/0.6; 53/527; 83/913; 156/155

[58] Field of Search ..... 19/0.6, 0.46; 264/143, 264/177.19, 211.14; 83/913; 156/250, 155, 180; 53/527

[56] References Cited

U.S. PATENT DOCUMENTS

| | | | |
|---|---|---|---|
| 2,729,028 | 1/1956 | Slayter et al. | 83/913 X |
| 3,921,874 | 11/1975 | Spain . | |
| 4,003,773 | 1/1977 | Grable . | |
| 4,025,252 | 5/1977 | Hunke . | |
| 4,158,555 | 6/1979 | Kallenborn | 83/913 X |
| 4,457,785 | 7/1984 | Hsu et al. | 162/156 |
| 4,810,576 | 3/1989 | Gaa et al. | 428/395 X |
| 4,836,507 | 6/1989 | Yang | 264/211.14 X |
| 4,840,755 | 6/1989 | Nakazawa et al. | 264/143 X |
| 4,855,122 | 8/1989 | Kitamura et al. . | |
| 5,030,435 | 7/1991 | Kitamura et al. . | |
| 5,033,385 | 7/1991 | Zeren . | |
| 5,074,101 | 12/1991 | Rewitzer | 53/527 X |
| 5,074,214 | 12/1991 | Zeren . | |
| 5,093,060 | 3/1992 | Samuels et al. | 264/211.14 X |

FOREIGN PATENT DOCUMENTS

| | | | |
|---|---|---|---|
| 249872 | 12/1987 | European Pat. Off. . | |
| 254016 | 1/1988 | European Pat. Off. . | |
| 52-74029 | 6/1977 | Japan | 19/0.6 |

OTHER PUBLICATIONS

*Chemical Abstracts,* vol. 100, No. 24, Jun., 1984, Abstract No. 193–461r, "Carbon Fiber Manufacture".

*Chemical Abstracts,* vol. 104, 1986, Abstract No. 131395w, "Carbon Fiber Manufacture".

*Chemical Abstracts,* vol. 104, 1986, Abstract No. 226269x, "Continuous Pitch Carbon Fiber Manufacture".

*Primary Examiner*—Jeff H. Aftergut

*Attorney, Agent, or Firm*—Ivan G. Szanto; Joanne W. Patterson

[57] ABSTRACT

Chopped fiber strands are produced by (1) wetting a continuous unsized fiber tow with a volatile sizing agent, (2) chopping the wet fiber tow into predetermined lengths, and (3) exposing the chopped fibers to conditions of temperature and pressure that remove the sizing agent by volatilizing but do not cause any structural changes in the fiber. Bundles of the unsized fibers have a high bulk density and are easily dispersible in air or other media to individual filaments or groups of small numbers of individual filaments. The process is especially useful for producing high bulk density packages of polyacrylonitrile-based carbon fibers.

32 Claims, No Drawings

METHOD FOR PRODUCING CHOPPED FIBER STRANDS

This application is a continuation of application Ser. No. 08/014,020 filed Feb. 5, 1993, now abandoned.

FIELD OF THE INVENTION

This invention relates to a method for producing chopped carbon fiber strands.

BACKGROUND OF THE INVENTION

Carbon fibers are used as reinforcing materials in a variety of applications ranging from aerospace to sporting goods. In order to achieve improved mechanical properties, these fibers are typically used as continuous materials either in prepreg form or as filament wound materials to produce composite articles. However, chopped fibers, either sized or unsized, are also used in order to reduce cost, in applications where less than optimal mechanical properties are acceptable or in applications where other physical properties, such as electrical properties, are important.

One of the problems associated with handling unsized carbon fibers is their tendency to separate from one another. As a consequence, they cannot be chopped into shorter lengths without "fluffing". The result is that the dry, chopped fibers have a very low bulk density. In many uses this low bulk density is a disadvantage, since it makes the material hard to handle, hard to package, and hard to incorporate or mix with other materials.

The fibers are therefore typically sized with a nonvolatile sizing agent that holds the fibers together and protects the bundle both during and after chopping. This sizing agent is generally chosen to be compatible with the resinous matrix material that the fibers will reinforce and as such, the sizing becomes a part of the chopped fiber bundle and composite article. Since the sizing remains on the fiber, the fiber bundles are not easily dispersed until they are added to the matrix resin and then only if the sizing agent and matrix resins are compatible.

Other methods for holding the chopped fiber bundles together have also been disclosed. For example, U.S. Pat. No. 4,003,773 discloses passing a continuous tow through a bath of liquid impregnating material at an elevated temperature. After controlling the amount of material applied to the tow, the tow is chopped into discs of desired thickness and the impregnating material is removed by dissolving it in a solvent. U.S. Pat. No. 3,921,874 discloses forming chopped fiber bundles by impregnating the continuous fiber tows with a liquid such as water, collimating the fiber bundles, freezing the liquid, and chopping the fiber into discrete bundles. After chopping, the impregnant is melted and the fiber bundles are dried to remove the liquid. U.S. Pat. No. 5,030,435 teaches a process for producing chopped pitch-based carbon fiber strands which comprises coating a pitch strand with a low-boiling solvent such as water or methanol, cutting the pitch strand to a predetermined length, then carbonizing the chopped strands in an inert atmosphere. Bundles of chopped fibers exhibiting high bulk densities are reported.

In addition to being used as reinforcing agents in composite structures, chopped carbon fibers can be dispersed in air to obscure military vehicles from millimeter-wave radar. These chopped fibers must be packaged for subsequent dispersal, and the volume of the package is critical for handling large amounts of short fibers. If the packing density is low, too much volume is occupied and the fiber cannot be transported within the limited confines of a military vehicle.

Packages of chopped fibers that are more densely packed than those presently available would be valuable, since the package volume could be reduced dramatically and many more pounds of fiber could be carried in a limited volume. The fibers would also have to be easily dispersible, either in air or in another medium such as a matrix resin used in the manufacture of composite structures.

SUMMARY OF THE INVENTION

The process of the present invention for producing chopped fiber strands comprises the following steps in sequence: (1) wetting a continuous, unsized fiber tow with a liquid comprising a volatile sizing agent, (2) chopping the liquid-wet fiber tow into predetermined lengths, and (3) exposing the chopped tow to conditions of temperature and pressure that remove the sizing agent by volatilizing but do not cause any structural changes in the fiber. The chopped tow can be packaged after chopping or dispersed in a resin matrix before removing the liquid by volatilizing. Optionally, pressure can be applied during packaging to produce a package of fibers with an even higher bulk density. The process is especially useful for producing high bulk density packages of unsized polyacrylonitrile (PAN)-based carbon fibers.

The process of this invention provides a method for coating a fiber tow with a sizing agent that is easily removed after chopping. The bundles of chopped fibers exhibit improved handling and packaging characteristics at high bulk density. After packaging and removal of the sizing agent, the densely packed, unsized chopped fibers are easily dispersed in air or another medium into individual fine fibers or small groups of individual filaments. Bundles of unsized chopped fibers prepared by the process of this invention exhibit a bulk density greater than about 20% of the fiber density.

DETAILED DESCRIPTION OF THE INVENTION

By wetting continuous unsized fiber tows with a liquid, volatile sizing agent, the fiber bundles are held together in a compact manner during chopping. The chopped fiber bundles, which are still wetted with the sizing agent in its liquid state, are then maintained in this compact manner during packaging to maximize bulk density. The bundles of fibers that were sized before chopping occupy considerably less volume than bundles of chopped, unsized fibers, and therefore have a much higher bulk density. The fibers are exposed to conditions of temperature and pressure that remove the sizing agent by volatilizing it, preferably after packaging or mixing with some other material such as a thermoplastic or thermoset resin. Alternatively the sizing agent can be removed from the chopped fibers before packaging or mixing.

The process of this invention can be used with continuous fiber tows of any organic or inorganic fiber or mixture of fibers that is insoluble in the liquid, volatile sizing agent. Suitable inorganic fibers include carbon, glass, ceramic, and metal, e.g., boron, fibers and mixtures thereof. The process is especially useful for polyacrylonitrile (PAN)-based carbon fibers.

The unsized continuous tow is wet just prior to chopping with the volatile sizing agent. By "volatile" it is meant that the sizing agent is a low-boiling, high vapor pressure liquid.

Preferred sizing agents include, for example, water, alcohols, ketones, chlorinated hydrocarbons, and mixtures thereof. Water is most preferred, since it is inexpensive, nontoxic and does not present subsequent environmental problems. The concentration of volatile sizing agent on the fiber tow is typically in the range of about 5%–75% by weight of wet fiber, preferably 10%–40%. The sizing agent may contain materials that remain behind when the sizing agent is removed, e.g., powdered graphite to reduce friction between the fibers.

After wetting, the liquid-wet fiber tow is chopped with a cutting or chopping apparatus to a predetermined length, preferably 1 to 50 mm, and more preferably 5 to 25 mm. After chopping, the chopped fiber bundles can be loaded into a suitable packaging container, or the chopped fiber bundles can be added to a resin matrix to form a composite material.

When used, the packaging container is preferably one in which the chopped fibers can be loaded so that they are aligned in the same plane to maximize bulk density. Optionally, pressure can be applied to compress the fibers within the container during packaging, e.g., by means of a piston, to maximize bulk density. In such a process, the container is partially filled with fibers, the fibers are compressed, additional fibers are added and these steps are repeated until the container is completely filled with chopped fibers. Either before or after packaging, the fibers are exposed to conditions of temperature and pressure that remove the sizing agent by volatilizing it. The temperature used is preferably above the boiling point of the volatile sizing agent that is employed, and is below the temperature at which any structural change takes place in the fiber. However, a combination of lower temperatures and reduced pressure can also be used to remove the sizing agent. By structural change is meant any chemical or morphological change in the fiber, for example, the changes occurring during insolubilization and carbonization of a pitch-based fiber. When water is used as the sizing agent, it is preferably removed at a temperature in the range of about 80° C. to 200° C., more preferably about 95° C. to 150° C., at atmospheric pressure (14.7 psi). Once the sizing agent is removed, the fibers are easily dispersible in air or other media to individual filaments or groups of small numbers of individual filaments.

The bundles of unsized chopped fibers of this invention have a bulk density greater than about 20%, preferably greater than about 33%, and most preferably greater than about 40% of the fiber density. For PAN-based carbon fibers with a density of 1.8 g/cc, the fibers preferably have a bulk density greater than about 0.4 g/cc, more preferably greater than about 0.6 g/cc and most preferably greater than about 0.75 g/cc.

Bulk density is determined by weighing the dried fibers that occupy a container of known volume and dividing the mass of the fibers by the volume of the container.

The bundles of chopped fibers can be used as reinforcing agents for thermoplastic or thermoset matrix resins in the manufacture of composite structures. They can also be dispersed in air for use as obscurants for millimeter-wave radar.

In this specification all parts and percentages are by weight unless otherwise noted.

EXAMPLE 1

Unsized AU4 12K (12,000 filaments per tow) carbon fiber available from Hercules Incorporated, Wilmington, Del., was sprayed with water as it was removed from its packaging spool. The amount of water present was approximately 35%, based on the weight of wet fiber. The wet fiber was fed to a rotary fiber chopper and was chopped to a length of 0.25 inches. The resulting wet chopped fibers were then loaded into a container of known volume and the fibers were subsequently dried to constant weight. The bulk density of this material was calculated on a dry basis to be 29.9 lb/ft$^3$ (0.48 g/cc).

EXAMPLE 2

The wet chopped fibers prepared as described in Example 1 were manually compressed with a pressure of ~25 psig to fill the container. After drying, the bulk density of this material was calculated on a dry basis to be 46.7 lb/ft$^3$ (0.75 g/cc).

COMPARATIVE EXAMPLE 1

Unsized AU4 12K carbon fiber available from Hercules Incorporated was chopped dry in a rotary fiber chopper to a length of 0.25 inches. The resulting chopped carbon fibers were manually compressed with a clear plastic disc at a pressure of ~25 psig to fill the same container as in Example 2. The bulk density of this material was calculated to be 7.5 lb/ft$^3$ (0.12 g/cc).

EXAMPLE 3

The fibers used in this example were unsized AU4, AS4 (both ~7.5 micron filament diameter), and IMU (~5.5 micron diameter) 12K carbon fibers available from Hercules Incorporated, Wilmington, Del. AS4 carbon fiber is electrolytically surface treated to improve adhesion to matrix resins. AU4 and IMU fibers are not surface treated. The fibers were chopped according to the process described in Example 1. Chopped fiber lengths were 0.25" and 0.125". Samples of each of the wet chopped fibers were transferred to a small, tared aluminum dish (I.D.=1.964", area=3.03 in$^2$). The samples were then dried in the dishes, the occupied volume was measured and the non-compacted, or "free" bulk density was calculated. Next, a clear plastic disc was cut that just fit over the opening in the aluminum dish and the disc was manually pressed to compress the fiber to its maximum compression. The compressed occupied volume was measured and the compacted bulk density was calculated. The calculated bulk densities for these samples is shown in Table 1.

TABLE 1

| Fiber Type | Free Bulk Density (g/cc) | Compressed Bulk Density (g/cc) |
|---|---|---|
| ¼" AU4 | 0.59 | 0.80 |
| ⅛" AU4 | 0.48 | 0.72 |
| ¼" AS4 | 0.63 | 0.70 |
| ⅛" AS4 | 0.84 | 0.97 |
| ¼" IMU | 0.71 | 0.91 |
| ⅛" IMU | 0.69 | 0.94 |
| ⅛" IMU (predried) | 0.29 | |

COMPARATIVE EXAMPLE 2

Dry FORTAFIL ¼" unsized chopped carbon fiber available from Akzo Corp. was used in this example. Bulk density was determined using the following procedure. Approximately 30 g of chopped fiber were loaded into an aluminum cylinder with an internal cross-sectional area of 62.07 $cm^2$. A five pound plunger was used to compress the fiber sample and the compressed height was recorded. The bulk density was then calculated to be 0.12 g/cc. A second sample of this fiber was "poured" into a one liter beaker. The weight of fiber used was recorded and the occupied volume calculated. The "free" bulk density was calculated to be 0.033 g/cc.

EXAMPLE 4

Wet chopped AU4 fibers, prepared as described in Example 1 except for containing approximately 20% water, based on the weight of wet fiber, were tested for bulk density using the method described in Comparative Example 2. The wet chopped fibers were loaded into the aluminum cylinder and compressed in the wet state. The fibers were then dried and the bulk density on a dry basis was calculated to be 0.97 g/cc.

EXAMPLE 5

Wet chopped AU4 fibers, prepared as described in Example 1 were tested for bulk density using the method described in Example 4, except that the fibers were dried before loading into the aluminum cylinder. After compressing, the bulk density was calculated to be 0.59 g/cc.

EXAMPLE 6

A Lucite tube with an internal diameter of 3.24" and length of 22.25" was loaded with 3207.4 g wet chopped ¼" AU4 carbon fiber, prepared as described in Example 1 except that the water content was approximately 15%, based on the weight of wet fiber. After loading, the fiber was manually compressed and dried in the tube at a temperature of ~80° C. The dry weight of fiber was 2723.5 g. Based on a loaded volume of 3006 $cm^3$, the calculated bulk density was 0.91 g/cc.

EXAMPLE 7

A box with an internal volume of 20,746 $cm^3$ was loaded with wet ¼" chopped AU4 fiber, prepared as described in Example 1. After loading, the fiber was dried at 95° C. for one day followed by three days at 104° C., after which time the fiber was dry to constant weight. The box was shown to contain 13,980 g of dry fiber for a bulk density of 0.67 g/cc.

We claim:

1. A process for preparing chopped fiber strands consisting essentially of the following steps in sequence: (a) wetting a continuous unsized fiber tow with a liquid consisting essentially of a volatile sizing agent, (b) chopping the fiber tow while still wetted with the sizing agent in its liquid state into predetermined lengths, and (c) exposing the chopped fibers to conditions of temperature and pressure that remove the sizing agent by volatilizing, no structural changes taking place in the fibers during steps (a), (b), and (c), said process producing chopped fiber strands held together in a compact manner which can easily be dispersed in air or another medium into individual fine fibers or small groups of individual filaments.

2. The process of claim 1 wherein the sizing agent is volatilized and the chopped fibers are then packaged in a container in such a manner that the fibers are substantially arranged in the same plane.

3. The process of claim 2 wherein pressure is applied during packaging.

4. The process of claim 3 wherein the chopped fiber strands have a bulk density of greater than about 20% of the fiber density.

5. The process of claim 1 wherein the chopped fibers are packaged in a container in such a manner that the fibers are substantially arranged in the same plane and the sizing agent is then volatilized.

6. The process of claim 5 wherein compressing pressure is applied during packaging.

7. The process of claim 6 wherein the chopped fiber strands have a bulk density of greater than about 33% of the fiber density.

8. The process of claim 7 wherein the chopped fiber strands have a bulk density of at least about 40% of the fiber density.

9. The process of claim 6 wherein the sizing agent is selected from the group consisting of water, alcohols, ketones, chlorinated hydrocarbons and mixtures thereof.

10. The process of claim 6 wherein the fiber tows are selected from the group consisting of carbon, glass, metal and ceramic fiber tows and mixtures thereof.

11. The process of claim 10 wherein the fiber tows are carbon fiber tows.

12. The process of claim 6 wherein the volatile sizing agent is water and the fiber tows are PAN-based carbon fiber tows.

13. The process of claim 5 wherein the chopped fiber strands have a bulk density of greater than about 20% of the fiber density.

14. The process of claim 13 wherein the chopped fiber strands have a bulk density of greater than about 33% of the fiber density.

15. The process of claim 5 wherein the fiber tows are selected from the group consisting of carbon, glass, metal and ceramic fiber tows, and mixtures thereof.

16. The process of claim 15 wherein the fiber tows are carbon fiber tows.

17. The process of claim 5 wherein the sizing agent is selected from the group consisting of water, alcohols, ketones, chlorinated hydrocarbon and mixtures thereof.

18. The process of claim 5 wherein the volatile sizing agent is water and the fiber tows are PAN-based carbon fiber tows.

19. The process of claim 1 wherein the chopped fiber tow is dispersed in a matrix resin for the manufacture of composite structures and the sizing agent is then volatilized.

20. The process of claim 1 wherein the sizing agent is volatilized and the chopped fiber tow is then dispersed in a matrix resin for the manufacture of composite structures.

21. The process of claim 1 wherein the fiber tow is selected from organic fiber tows, inorganic fiber tows, and mixtures thereof that are insoluble in the sizing agent.

22. The process of claim 21 wherein the fiber tows are inorganic fiber tows.

23. The process of claim 22 wherein the fiber tows are selected from the group consisting of carbon, glass, metal and ceramic fiber tows, and mixtures thereof.

24. The process of claim 23 wherein the fiber tows are carbon fiber tows.

25. The process of claim 24 wherein the fiber tows are polyacrylonitrile-based carbon fiber tows.

26. The process of claim 1 wherein the volatile sizing agent is selected from the group consisting of water, alcohols, ketones, chlorinated hydrocarbons and mixtures thereof.

27. The process of claim 26 wherein the volatile sizing agent comprises water.

28. The process of claim 27 wherein the water is volatilized at a temperature of from about 80° C. to about 200° C. at atmospheric pressure.

29. The process of claim 28 wherein the water is volatilized at a temperature of from about 95° to about 150° C. at atmospheric pressure.

30. The process of claim 1 wherein the volatile sizing agent is present on the fiber tow in an amount of 5%–75% by weight of the wet fibers.

31. The process of claim 30 wherein the volatile sizing agent is present on the fiber tow in an amount of 10%–40% by weight of the wet fibers.

32. The process of claim 1 wherein the volatile sizing agent is water and the fiber tows are PAN-based carbon fiber tows.

* * * * *